United States Patent [19]

Ginatta et al.

[11] Patent Number: 4,670,121

[45] Date of Patent: Jun. 2, 1987

[54] PLANT FOR THE ELECTROLYTIC PRODUCTION OF REACTIVE METALS IN MOLTEN SALT BATHS

[75] Inventors: Marco V. Ginatta; Gianmichele Orsello, both of Turin, Italy

[73] Assignee: Elettrochimica Marco Ginatta S.p.A., Turin, Italy

[21] Appl. No.: 885,626

[22] Filed: Jul. 15, 1986

[30] Foreign Application Priority Data

Jul. 22, 1985 [IT] Italy ..... 67669 A/85

[51] Int. Cl.[4] ..... C25D 17/00

[52] U.S. Cl. ..... 204/225; 204/241; 204/245; 204/246; 204/247; 204/288; 204/297 R

[58] Field of Search ..... 204/243 R–247, 204/241, 288, 64 T, 297 R, 68, 70, 286

[56] References Cited

U.S. PATENT DOCUMENTS 3,562,134 2/1971 Love ..... 204/244 X
3,580,835 5/1971 Peterson ..... 204/243 R
3,634,224 1/1972 Garab et al. ..... 204/243 R X
4,089,770 5/1978 Lemke ..... 204/247
4,415,422 11/1983 Birkle et al. ..... 204/246 X

*Primary Examiner*—Donald R. Valentine
*Attorney, Agent, or Firm*—Sughrue, Mion, Zinn, Macpeak, and Seas

[57] ABSTRACT

The plant for the electrolytic production of a metal in a molten salt bath by deposition at the cathode in the solid state includes an outer casing, means for maintaining an atmosphere inert to the metal to be produced in the casing, a container within the casing and arranged to contain the molten salt bath and having a movable cover, a plurality of electrodes suspended in the molten salt bath each bearing on means for supporting it and connecting it electrically, the means comprising for each of the electrodes a pair of electrically conductive elements facing each other and supported respectively by two opposite walls of the container and handling means associated with the outer casing for removing any one of the electrodes from the container after raising of the movable cover.

16 Claims, 12 Drawing Figures

Figures 1, 4:
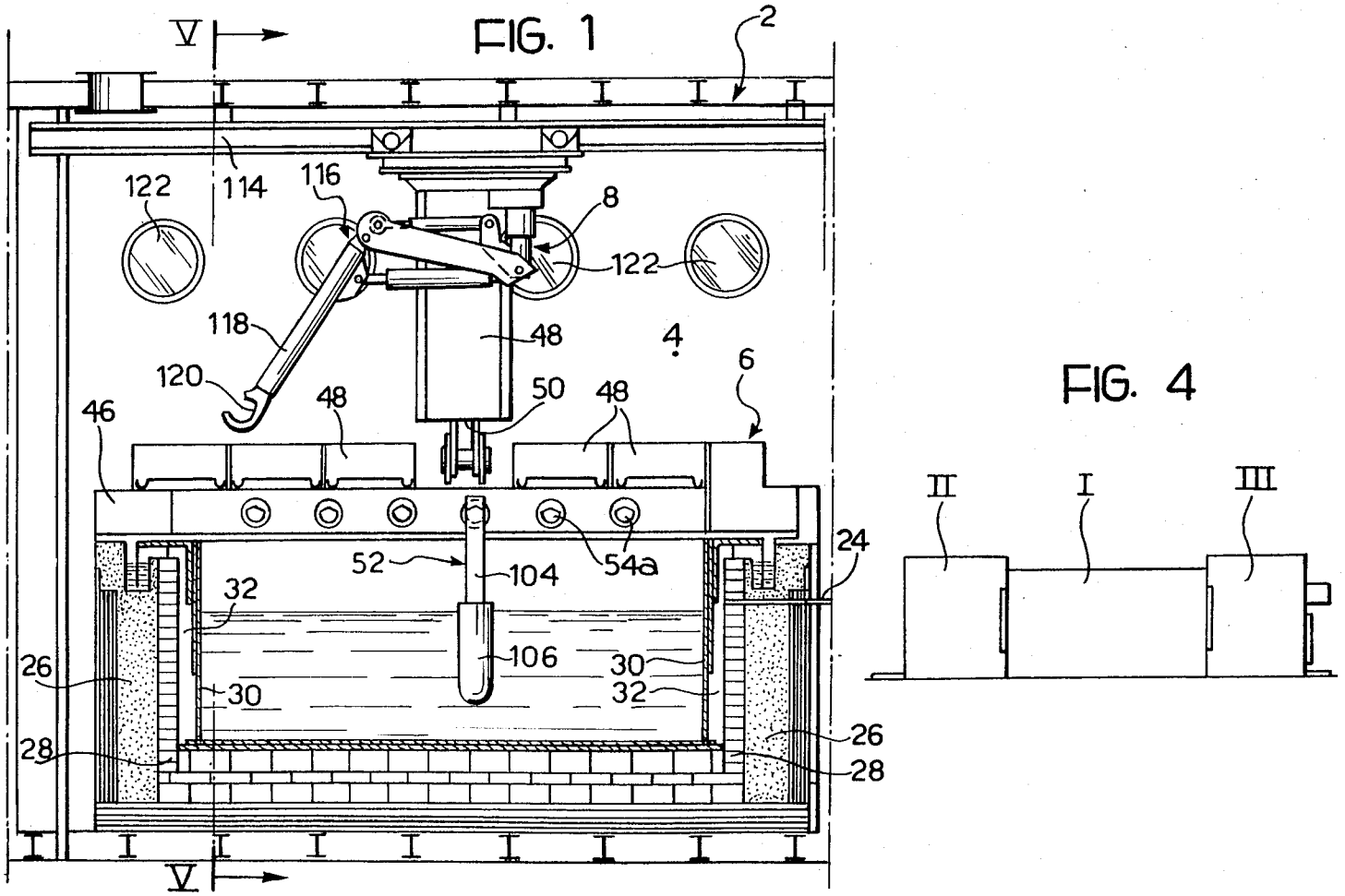

2
4
6
8
24
26
28
30
32
46
48
50
52
54a
104
106
114
116
118
120
122
I
II
III
V
V

PLANT FOR THE ELECTROLYTIC PRODUCTION OF REACTIVE METALS IN MOLTEN SALT BATHS

The present invention relates to a plant for the electrolytic production of metals in molten salt baths, particularly for reactive metals such as titanium, zirconium and hafnium.

The electrolytic production of reactive metals presents serious operational difficulties.

A first difficulty lies in the need to carry out the electrolysis in a substantially sealed container for the bath of molten salts, both because of the evolution of gas during the electrolysis and in order to avoid contamination of the bath by atmospheric gases.

A second difficulty arises from the fact that the reactive metals mentioned above deposit on the cathode in the solid state as a result of the electrolysis, in the form of crystals adhering to the surface of the electrode, thus making it necessary to remove the cathode from the electrolytic cell to collect the metal.

A further difficulty lies in the high reactivity of the metal produced when in contact with air at high temperatures whereby the metal produced must be cooled in an inert atmosphere to allow it to be stored subsequently.

The difficulties mentioned above thus make material and energy exchange with the electrolysis environment extremely laborious and complicated, whereby the presently-known processes for production of reactive metals are essentially discontinuous, making it necessary to stop the electrolytic process, particularly for the collection of the metal produced.

In view of these disadvantages, the object of the present invention is to provide a plant which enables the metal to be produced continuously, overcoming the difficulties mentioned above.

A second object of the present invention is to provide a plant which is very versatile in use and such as to allow the processes of both extraction and refining of the reactive metal to be carried out in the electrolytic cell.

A further object of the present invention is to provide a plant which, by virtue of its versatility, may be used for experimental purposes, by allowing the arrangement and configuration of the electrodes to be varied easily within the electrolytic cell.

Accordingly, the present invention provides a plant characterised in that it comprises:

an outer casing, means for maintaining an atmosphere substantially inert to the metal to be produced in the casing, a container disposed within the casing and arranged to contain the molten salt bath and having an upper opening provided with a movable, cover, a plurality of electrodes arranged to be suspended in the molten salt bath, a plurality of electrical connecting and support means comprising, for each of the electrodes, a pair of electrically conductive elements disposed facing each other on two opposite walls of the container adjacent its opening, each of the electrodes being suspended in the molten salt bath resting on the said pair of conductive elements, and handling means associated with the outer casing and adapted to remove any one of the said electrodes from the container.

By virtue of the combination of the characteristics mentioned above, the plant according to the invention enables the electrolysis of molten salts to be carried out with an easy operation procedure equivalent to that which characterises electrolysis processes in aqueous solutions.

Moreover it will be appreciated that the plant of the invention differs from prior art plants in that the container fulfils solely the function of containing the electrolyte and not that of achieving a gas seal for isolating the electrolysis environment from the external atmosphere, this latter being a function of the outer casing. This fact results in important operational advantages such as the possibility of keeping the molten salt bath at higher temperatures or the possibility of keeping a lower absolute pressure in the container than can be achieved in conventional plants. In terms of structure, the plant allows the parts of the container in contact with the electrolyte to be made from materials such as mild steel with modest structural strength, particularly those compatible with electrolytes typically used, even under extremely high temperature and vacuum conditions.

Figure 2:
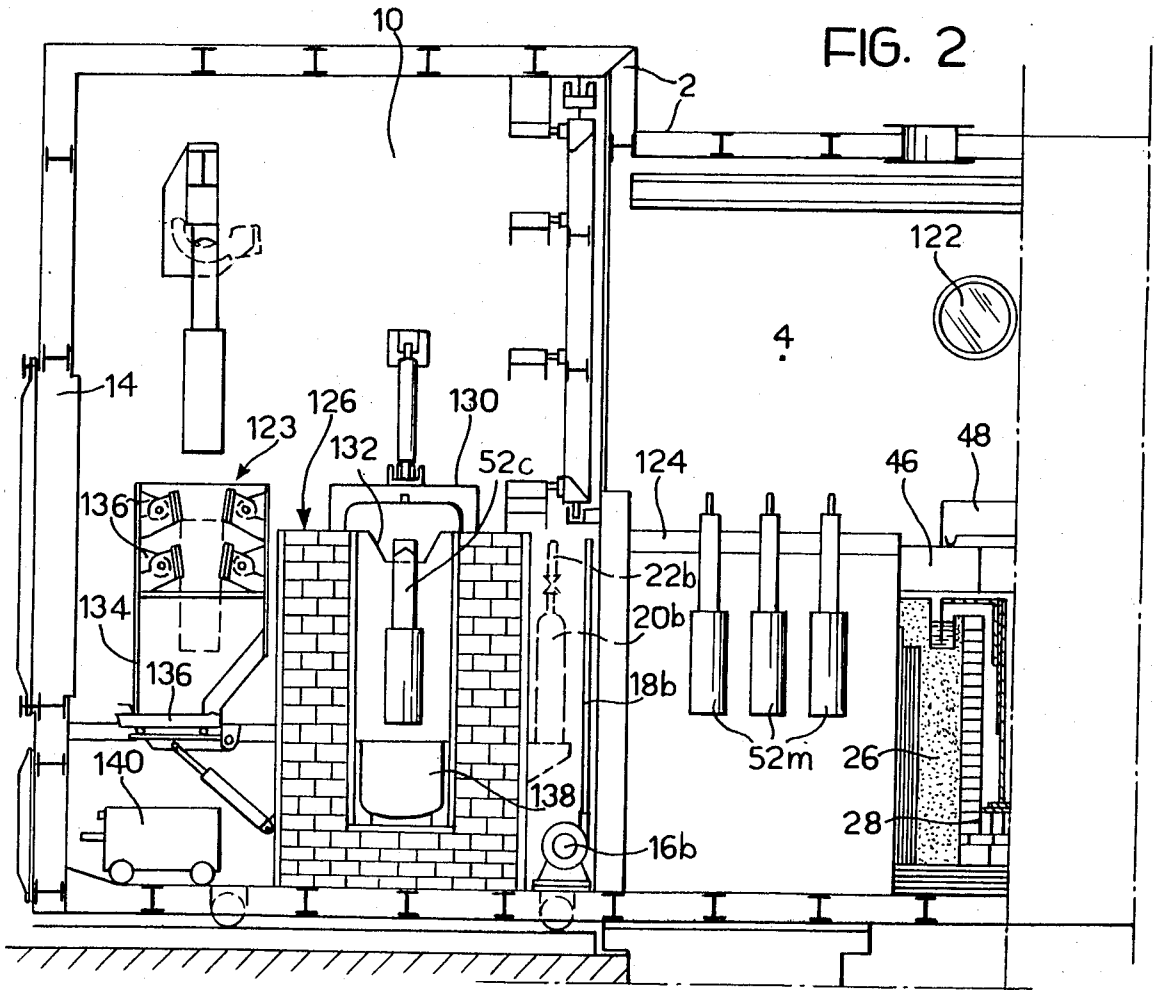
Figure 3:
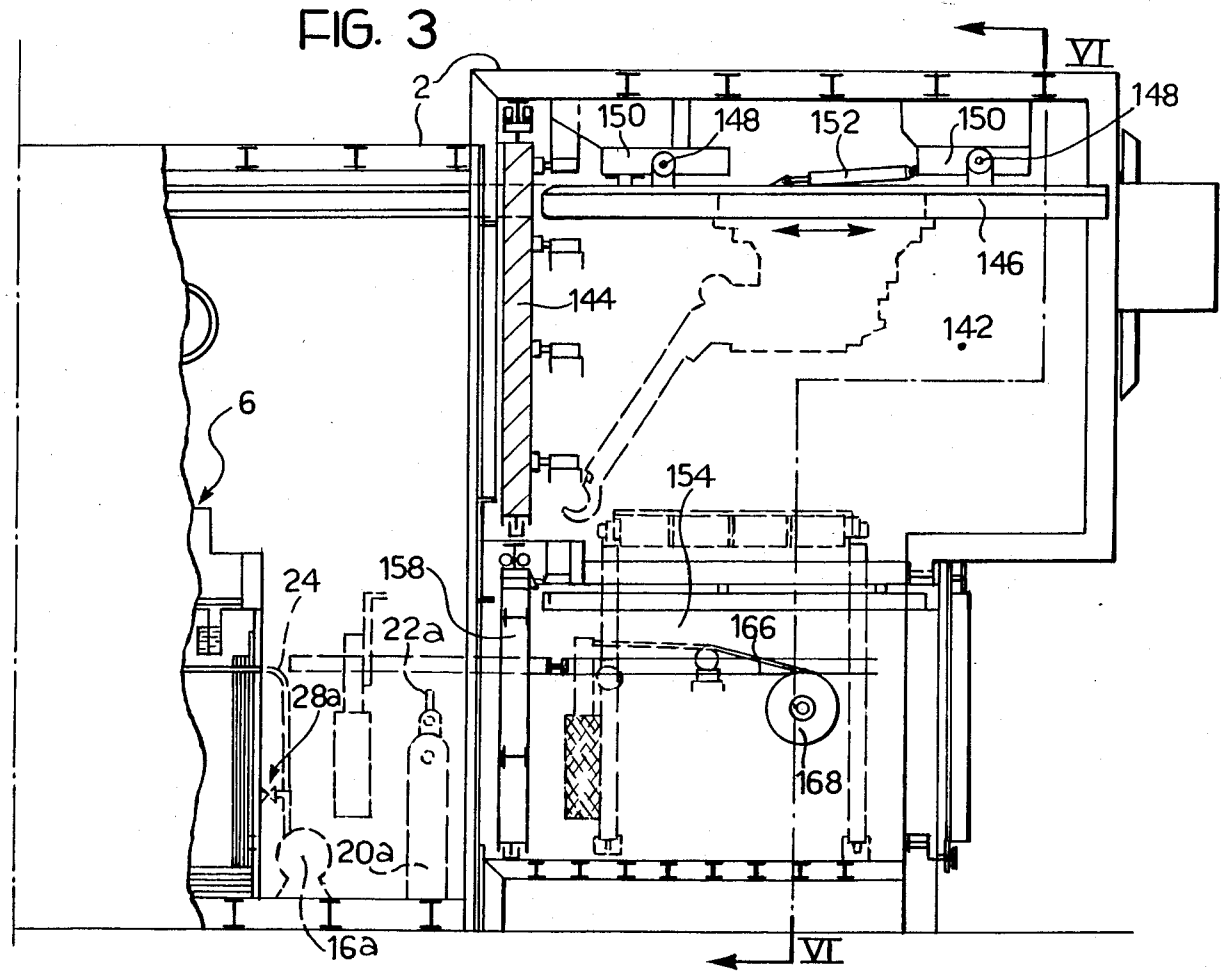
Figure 8:
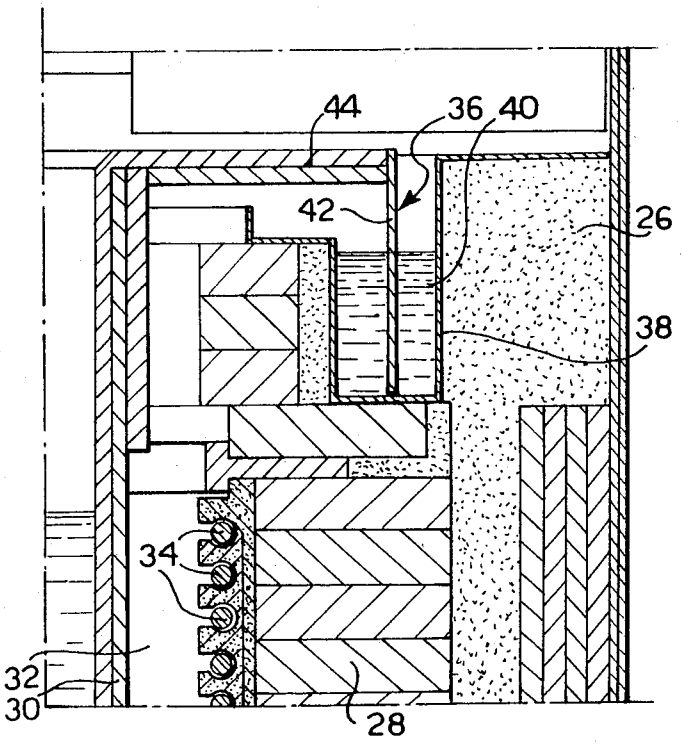
Figure 5:
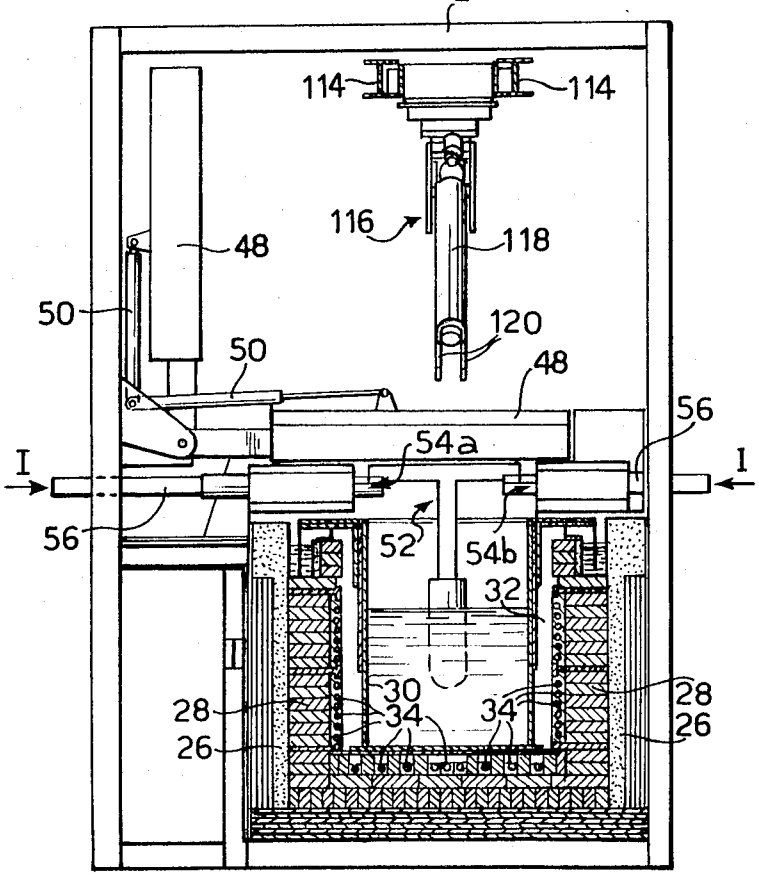
Figure 6:
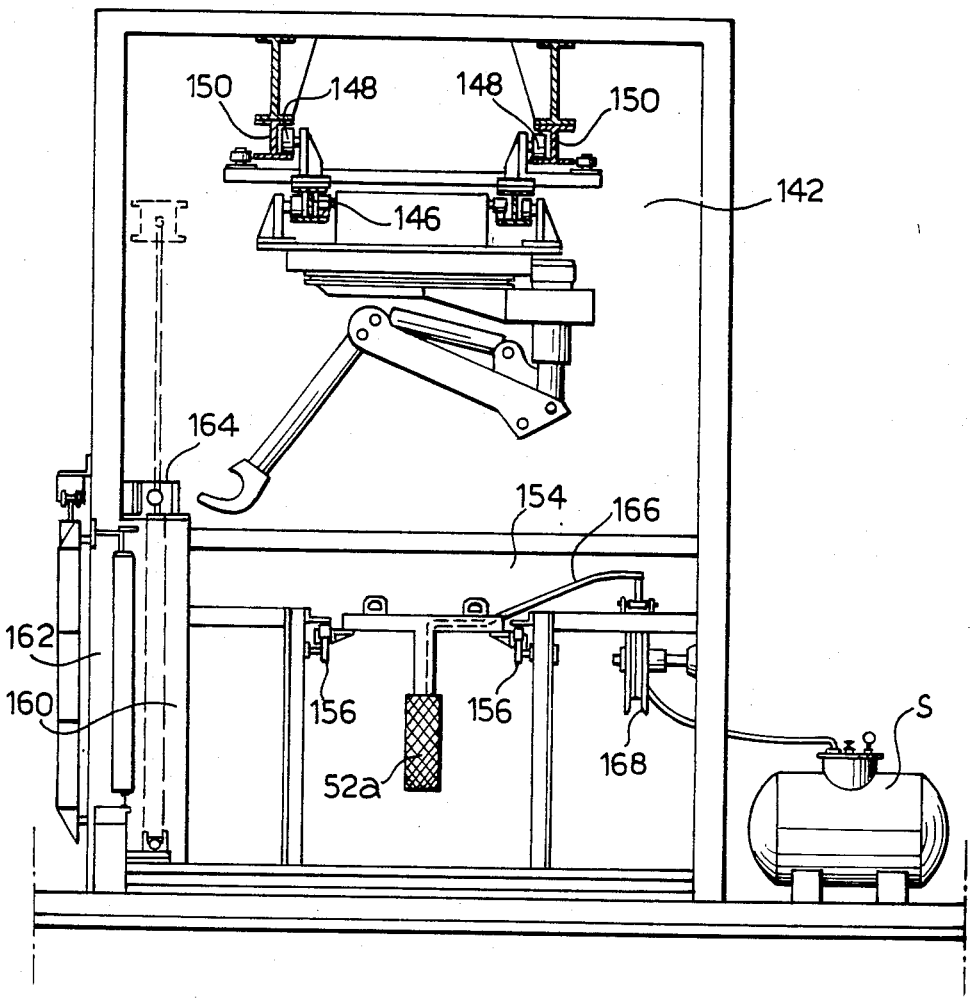
Figure 7:
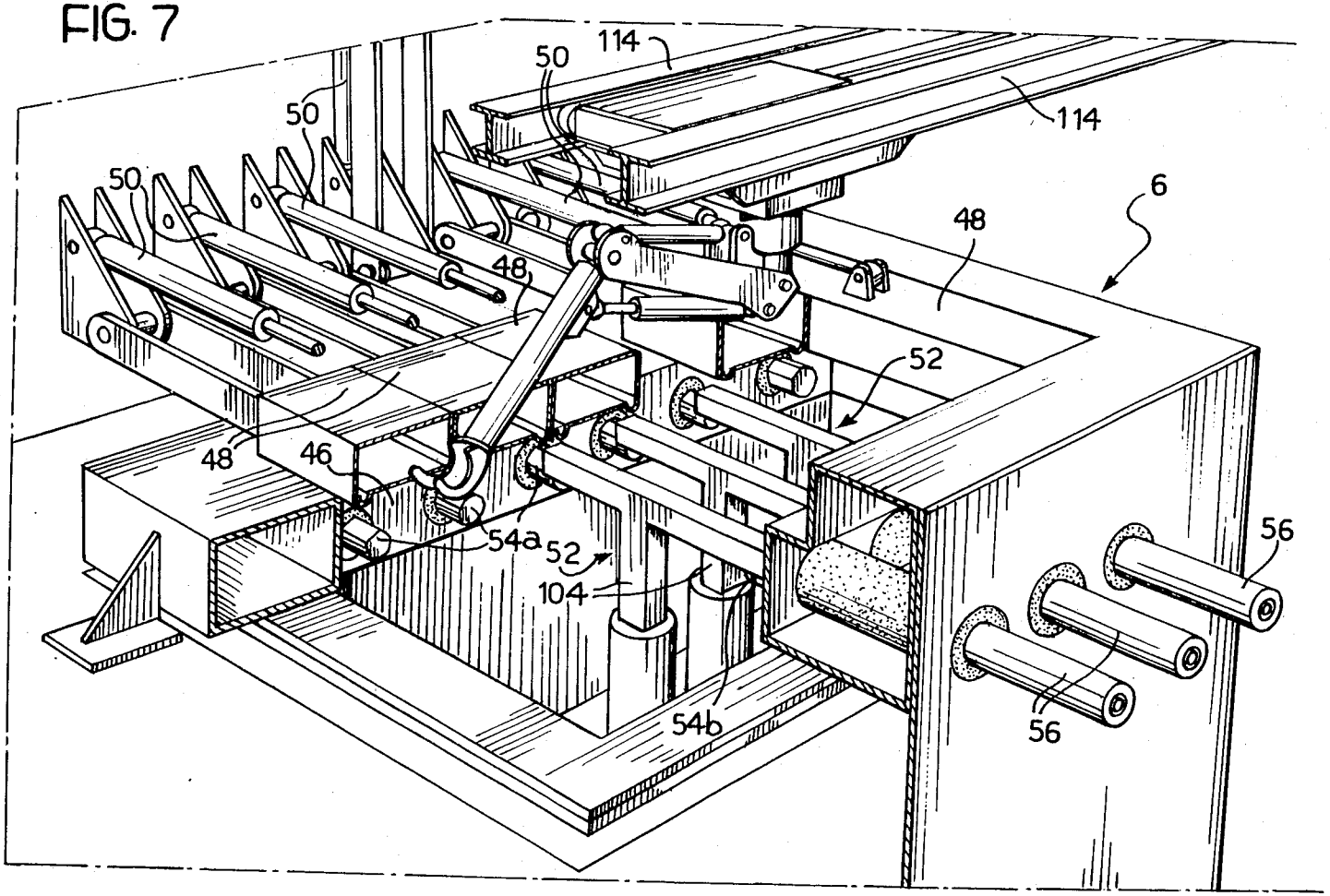
Figure 9:
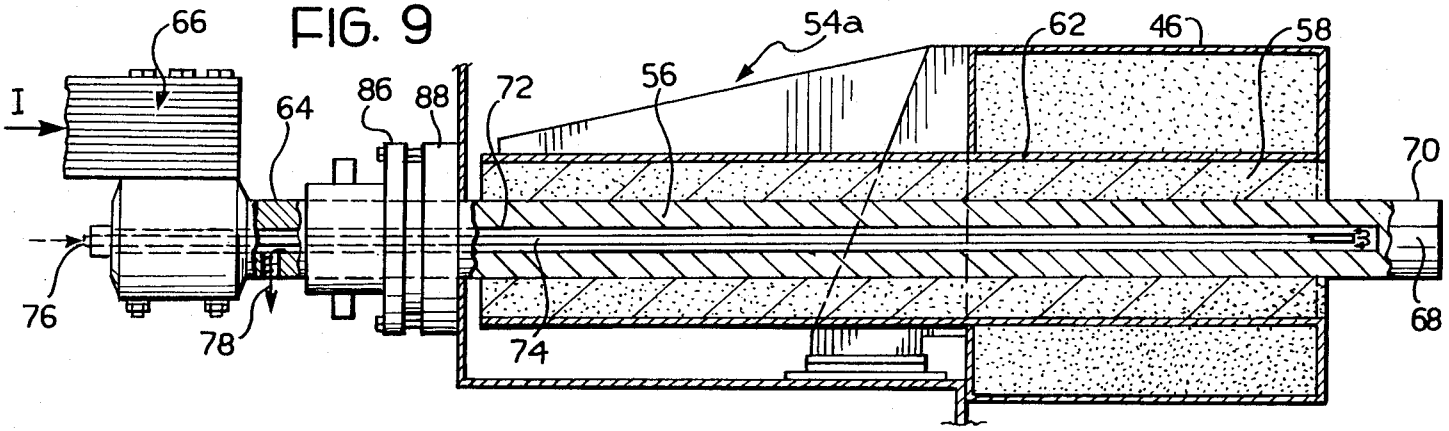
Figure 10:
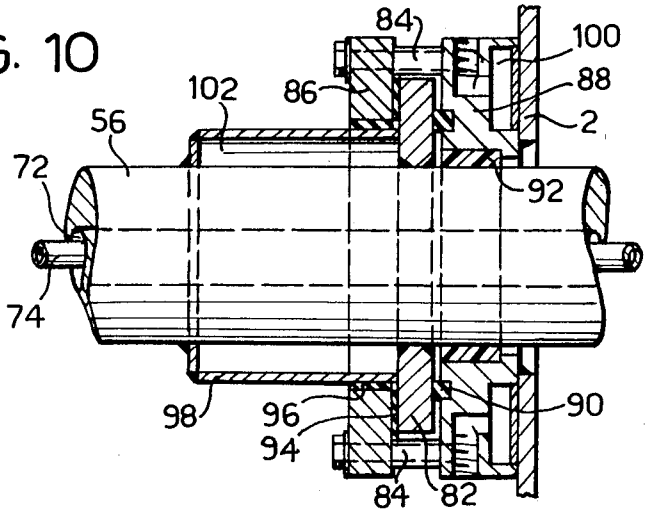
Figure 11:
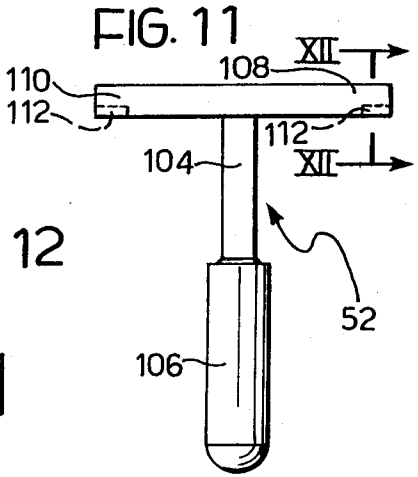
Figure 12:
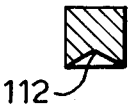

Further advantages and characteristics of the plant according to the invention will become apparent from the detailed description which follows, provided purely by way of non-limiting example, in which:

FIGS. 1, 2 and 3 are schematic longitudinal sectional views illustrating respective adjacent portions of the plant of the invention, FIG. 4 is a schematic view illustrating how the portions of FIGS. 1, 2 and 3 are connected together, FIG. 5 is a schematic cross sectional view taken on the line V—V of FIG. 1, FIG. 6 is a schematic cross sectional view taken on the line VI—VI of FIG. 3, FIG. 7 is a partial perspective view illustrating details of the plant, FIG. 8 is a sectional view of an enlarged detail of FIG. 5, FIG. 9 is a partially sectioned view illustrating a detail of the plant, FIG. 10 is a partially sectioned view of a detail of FIG. 9, FIG. 11 illustrates an electrode usable in the plant of the invention, and FIG. 12 is a sectional view taken on the plane XII—XII of FIG. 11.

With reference to the drawings, a plant according to the invention comprises an outer metal casing 2 defining a main chamber 4 which is substantially isolated from the exterior and in which there are a container 6 for the bath of molten salts and for carrying out the electrolysis, and handling means 8.

The casing 2 includes an prechamber 10 for allowing the exchange of material between the external environment and the main chamber 4. For this purpose the prechamber 10 has gas tight doors 12 and 14 which put the prechamber 10 into communication with the chamber 4 and with the external environment respectively.

Outside the casing 2 are vacuum pumps **16*a* and 16*b* with respective suction tubes 18*a* and 18*b* communicating respectively with the chamber 4 and with the prechamber 10 to maintain a controlled atmosphere, in particular an atmosphere inert to the metal to be produced, therein. 20*a* and 20*b* indicate reservoirs of pressurised inert gas, typically argon, which supply the inert gas to the casing 2 through tubes 22***a* and 22*b* respectively.

The container 6 for the bath of molten salts is preferably of parallelapipedal shape and includes a heat insulating refractory lining 26 adjacent the casing 2 and a refractory inner lining 28. Within the refractory inner lining is a metal shell 30, also of parallelapipedal shape, constituting the crucible for containing the bath of molten salts. The metal shell 30 is located resting on the base of the refractory inner lining 28. Preferably there is a gap 32 between the side walls of the shell 30 and of the refractory inner lining 28. A plurality of heating elements 34 (FIG. 5) is incorporated in that part of the side walls of the refractory inner lining 28 facing the lateral walls of the shell 30 for providing, by radiation, the heat needed to bring the bath of salts within the crucible to melting poiint and possibly to maintain this temperature. A plurality of heating elements 34 is also incorporated in the base of the refractory inner lining 28.

The bath of molten salts may be heated by electrodes immersed in the electrolyte and supplied by a variable voltage transformer instead of by use of the heating elements 34 or in cooperation with these heating elements.

Preferably the container 6 has associated sealing means generally indicated 36 for preventing corrosive gases from inside the crucible penetrating the gap 32 and avoiding corrosion of the heating elements 34 protected. The sealing means comprise a vessel 38 encased along the entire upper edge of the refractory inner lining 28 and containing molten metal indicated 40. A fin 42 is immersed vertically in the molten metal in the vessel 38 and is welded to a flange 44 fixed to the upper edge of the shell 30. The choice of metal in the vessel depends on the temperature reached by the refractory material during the electrolysis, this metal having a melting point less than the operation temperature of the refractory material.

A tube 24 passes through the wall of the container 6 and communicates with the gap 32 and with the vacuum pump 16*a* in parallel with the tube 18*a* so as to maintain a pressure in the gap 32 which is substantially equal to the pressure existing in the chamber 4.

The outer casing 2 supports a frame structure 46 overlying the upper edge of the refractory inner lining 28 and acting as a support for a plurality of raisable cover members 48 which, when they rest on the frame structure 46 cover the container 6, avoiding any substantial outflow of gaseous products from the electrolysis in the container 6 into the chamber 4.

Each cover member 48 has an associated fluid actuator 50 articulated to the wall of the outer casing 2 and arranged to allow the respective cover member to be raised into a vertical position to allow access to the handling means 8 within the container 6.

Within the container 6 are electrodes 52 resting on means 54*a* and 54*b* for supporting them and connecting them electrically (FIG. 9).

Each of the support and electrical connection means 54*a* and 54*b* comprises an electrically conductive member 56 constituted by a hollow steel bar surrounded tightly by an electrically insulating refractory sleeve 58 which is inserted in a tubular metal member 62. Each tubular member 62 extends through the frame structure 46 filled with refractory material in a direction perpendicular to the respective wall of the container 6. Each bar 56 has its end 64 outside the container 6 connected to electrical supply means 66 which supply a direct current I and its other end 68 projecting inwardly of the container 6. The end 68 of each bar has a dihedron shaped seat 70.

A pair of mutually facing bars 56 disposed in opposite walls of the container 6 support each of the electrodes 52.

Within the cavity of each bar 56 are heat exchange means constituted by two concentric tubes 72 and 74 in which a cooling fluid is circulated, being fed in at 76 and leaving at 78. The circulation of cooling fluid during production of the metal allows the bar itself to be kept at a high level of electrical conductivity, improving the power efficiency of the plant.

FIG. 10 illustrates in detail the device for mounting each bar 56 on the casing 2 for preventing air from entering the container 6 or the gaseous products from leaving it during the operation of the plant and for achieving electrical insulation of each bar.

To each bar 56 is welded an annular plate 82 gripped by stud bolts 84 between two annular plates 86 and 88. The annular plate 88 is welded to the outer casing 2 and compresses an annular sealing washer between it and the plate 82. Between the annular plate 88 and the outer surface of the bar 56 is a bush 92 of electrically insulating material such as asbestos or Teflon. An annular sealing washer 94 is interposed between the plate 82 and the plate 86. The plate 86 surrounds an annular washer 96 which surrounds a metal bush 98 welded to the bar 56. Channels 100 and 102 respectively are provided in the plate 88 and in the bush 98 for the circulation of cooling fluid.

FIG. 11 illustrates an electrode 52, particularly a cathode, suitable for use in the plant of the invention. The electrode comprises a body 104 which supports a hollow metal cylinder 106 for acting as a deposition surface for the metal to be produced. From the body branch two arms 108 and 110 having abutment recesses 112 at their distal ends, shaped in the form of dihedrons complementary to the dihedral seats 70 of the ends 68 of the bars 56.

The faces of the dihedron are typically at an angle of 110° to 130° to each other, preferably at 120° (FIG. 12).

The electrical contact between the electrode and the support bar is ensured by the weight of the electrode itself and the inclination of the bearing faces of the seats 70 for each bar 56 which reduces substantially the deposition of powder in the zones of electrical contact between the electrode and the respective support bar.

It is understood that the present invention is not intended to be limited to a specific arrangement of the electrodes 52 within the crucible or to their specific configuration, these being variable widely, while the principle described above of forming a rest for each electrode on the support and electrical connection means 54*a*, 54*b* remains the same.

It will be noted that the arrangement of the plant and particularly the mounting of the electrodes of the present invention allows all the electrodes to be under independent electrical control and also makes the replacement of the electrodes easy without the need for stopping production for dismantling the cell. This is particularly advantageous in relation to graphite anodes which may be subject to accidental breakage.

In the case of a power cut it is possible to intervene quickly to remove the electrodes from the electrolytic bath, thus avoiding breakage of the electrodes which could be caused by cooling of the bath giving rise to a reduction in volume.

The plant provides for the possibility of supplying the compound containing the metal to be produced either in gaseous or in solid form. It is also possible to operate the plant purely for the purpose of refining the crude metal.

In the case of a gaseous supply, supply ducts (not shown) may pass through the walls of the container 6. In the case of a solid supply, the solid metal compound or crude metal may be supplied by means of the handling means 8. For this purpose the anodes may have T-shaped bodies of the type shown in FIG. 11 with baskets fixed to their lower ends for containing the solid compound of the metal to be produced or the crude metal.

The container 6 preferably also has thermocouples for regulating its temperature, and probes and sensors for enabling the changes in each variable in the process to be monitored. Furthermore, the container 6 preferably has an associated suction pump supplied by a duct communicating with the interior of the crucible for withdrawing the gases produced during the electrolysis. The gas withdrawn may be sent to an external plant for scrubbing or recovery.

The handling means 8 comprise a guide-rail member 114 located within the casing 2 and arranged parallel to the longer side of the container 6. A handler 116 is slidably mounted on the guide 114, drive means being provided to move it. The handler 116 includes an articulated arm 118 having a tool 120 at its end for engaging the arms 108 and 110 of each electrode. Preferably the handler 116 has oleodynamic drives operable from outside the casing, the supply tubes for the operating fluid passing through seals in the walls of the outer casing.

In order to allow an electrode to be removed, or at least for the electrodes to be moved, it suffices to raise one or more of the dome elements 48 by means of the actuators 50 to allow for access of the handler 116 to the interior of the container 6 and the removal of the desired electrode. It is understood that this operation does not require the electrolytic production process to be interrupted. After opening of the sealed door 12, the electrode removed from the container 6 may be located, by means of the handler 116, in the chamber 10 for cooling and then for recovery of the metal product. Naturally a new electrode, for example an electrode **52*m* stored in the chamber 4 on a rack 124**, may be taken up immediately by means of the handler and positioned in the electrolytic bath without affecting production of the plant.

The handler may be controlled automatically or by means of an operator observing the interior of the casing directly through a plurality of portholes 122 provided with wipers mounted on the walls of the outer casing 2.

Further accessories of the plant of the invention include an oven 126 and a scraper device 128 located in the prechamber 10. The oven 126 has a movable dome 130 and support means 132 for suspending a cathode **52*c*** in the oven after its removal from the molten salt bath.

The scraper device 128 for recovering the metal product comprises a casing 134 with an openable bottom 136 and scraper means 136 for removing deposited metal from the surface of a cathode.

During the process for production of the metal, a cathode, on whose active surface the metal product has been deposited, is removed from the bath of molten salts and located by means of the handler 116 in the oven 126 which is kept at the melting point of the bath of molten salts. The cathode is kept in the oven for a time sufficient to allow the electrolyte on its surface to drain off completely; this electrolyte is rich in the metal to be produced which is dissolved in it in an ionic state and, being a material of value, is hence collected in a crucible 138 within the oven. Once the electrolyte has been recovered, the metal product is removed from the surface of the cathode by introduction of the cathode itself into the scraper device 128 by means of the handler 116. The metal product which collects on the openable bottom 136 is carried out of the casing 2 by means of a carriage 140.

According to a further characteristic, the casing also defines a chamber 142 for the recovery of the handler, adjacent the chamber 10 and communicating therewith through a sliding door 144. A controlled atmosphere is also maintained in the chamber 142 by means of a supply of inert gas. The chamber 142 has as its main function the recovery of the handler which is then transferred for maintenance and to reduce its time in the chamber 4 in which it is more exposed to gases from the production cell. For this purpose a rail 146 is provided in the chamber 142, aligned with the guide-rail member 114, and has rollers 148 so that it can slide along the guide 150 in which the rollers 148 engage for rolling movement. A pair of hydraulic actuators 152, operable from the exterior of the casing 2, move the rail 146 along the guides 150 to bring it into a position adjacent the rail 114, after opening of the sliding door 144, so as to constitute an elongation thereof and allow the movement of the handler into the recovery chamber 142.

Adjacent the chamber 4 there is also a chamber 154 in which electrodes **52*a* are stored, resting on guides 156 operated by hydraulic actuators, for transfer through a communicating door 158 into the chamber 4**.

Each of the electrodes **52*a* has a flexible tube 166 fixed to the body of the electrode itself for supplying the bath with the raw material in the form of particles of liquid or solid in a flow of inert gas. Each flexible tube is wound on a reel 168 and connected at its outer end to a reservoir S for the raw material. The electrode introduced into the chamber 4 through the communicating door 158 may be located in the cell by means of the handler, carrying with it the flexible tube for supplying the raw material, typically $TiCl_4$ or $TiO_2$ in the case of the production of titanium. Whenever the materials supplied block the supply tube, which may easily happen with the solid raw materials mentioned above, it is possible, according to the invention, to remove the electrode quickly from the bath and to position it in the chamber 154**, the flexible tube at the same time being wound up and replaced or cleaned so that the production can be continued, the supply of the raw material having being stopped for a very short period. This possibility constitutes a further advantage of the present invention over the prior art in that, in conventional plants, it is not possible to replace the tube for the raw material without stopping the operation of the entire cell.

Adjacent the chamber 154 a further chamber 160, provided with a movable dome 164 and communicating with the exterior through an access door 162 this chamber 160 being used for the storage of a plurality of test tubes for sampling the electrolyte. The sampling of the electrolyte is carried out by raising the movable dome 164, transferring the test tube by means of the handler into the bath of molten salts and then repositioning the test tube in the chamber 160. The independent access door 162 allows the sample taken to be removed from the casing 2 while limiting the flow of inert gas from the casing 2.

Naturally the principle of the invention remaining the same, the embodiments and details of realisation may be varied widely with respect to that described and illustrated purely by way of non-limiting example, without thereby departing from the scope of the present invention.

What is claimed is:

1. Plant for the electrolytic production of a metal in a molten salt bath, comprising:

an outer casing, means for maintaining an atmosphere substantially inert to said metal to be produced in said outer casing, a container disposed within said outer casing for containing said molten salt bath and defining an upper opening movable, cover means for closing said upper opening, a plurality of electrodes for suspension in said molten salt bath for deposition of said metal thereon, a plurality of electrical connecting and support means for said electrodes comprising, for each of said electrodes, a respective pair of electrically-conductive elements disposed facing each other one in each of two opposing walls of said container adjacent said opening, each said electrode being suspended in said molten salt bath resting on the respective said pair of conductive elements, and handling means associated with said outer casing and adapted to remove any one of said electrodes from said container.

2. The plant of claim 1, wherein each said conductive element is constituted by a hollow bar projecting inwardly of said container and defining, at its end within the container, a seat for the respective electrode, said bar having an end outside the container connected to electrical supply means, and wherein heat exchange means with fluid circulating in concentric tubes are provided within each hollow bar.

3. The plant of claim 2, wherein each said electrode comprises a body and two support arms projecting from the body, each said arm defining at its free end a shape complementary to that of said seat of the respective conductive element.

4. The plant of claim 3, wherein the recess in each arm is shaped as a dihedron.

5. The plant of claim 4, wherein the faces of the dihedron are at an angle of from 110° to 130° to each other.

6. The plant of claim 3, wherein each said electrode is T-shaped, said body constituting the stem of the T-shape and said arms constituting the cross piece of the T-shape.

7. The plant of claim 1, wherein said movable cover means comprise a plurality of raisable cover elements located adjacent each other and supported by the upper edge of said container, and wherein an actuator cooperates with each said cover element for raising it.

8. The plant of claim 1, wherein said container comprises a refractory lining adjacent the outer casing and a metal shell within the refractory lining for containing said molten salt bath.

9. The plant of claim 8, wherein heating means are incorporated in that part of the refractory lining facing the inner metal shell, and hydraulic sealing means are provided for preventing gas from infiltrating into the gap between the inner metal shell and the refractory lining.

10. The plant of claim 1, wherein said casing defines a main chamber, in which said handling means and said container are disposed, and an antechamber for receiving a said electrode on its removal from the molten salt bath after electrolysis, said antechamber communicating with said main chamber and with the external environment through gas tight doors.

11. The plant of claim 10, wherein an oven is located in said antechamber for receiving the said electrode after its removal from said bath of molten salts and for maintaining the electrode at a temperature above the melting point of the bath to enable the molten salts to drain from the surface of the electrode.

12. The plant of claim 10, wherein a scraper device is located in said antechamber for removing said metal from the surface of the electrode.

13. The plant of claim 10, wherein said outer casing further defines a chamber for recovery of the handling means communicating with the main chamber by means of a sliding door.

14. The plant of claim 13, wherein said handling means include a guide rail in said main chamber, and wherein said recovery chamber includes a movable rail member and drive means operable from the exterior of said casing to move said movable rail member into a position in which it constitutes an extension of said guide rail, said handler being movable along said guide rail and said rail member from said main chamber with said recovery chamber.

15. The plant of claim 10, further including a chamber for the storage of said electrodes communicating with said main chamber through a communication door.

16. The plant of claim 1, wherein each said electrode has an associated flexible tube for supplying raw material for production of said metal to said salt bath.

* * * * *